US009816220B2

(12) United States Patent
Ahn et al.

(10) Patent No.: US 9,816,220 B2
(45) Date of Patent: Nov. 14, 2017

(54) FABRIC TREATMENT APPARATUS

(71) Applicant: LG Electronics Inc., Seoul (KR)

(72) Inventors: Hyukjin Ahn, Seoul (KR); Sungho Song, Seoul (KR); Sungmin Ye, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 255 days.

(21) Appl. No.: 14/569,056

(22) Filed: Dec. 12, 2014

(65) Prior Publication Data

US 2015/0167229 A1 Jun. 18, 2015

(30) Foreign Application Priority Data

Dec. 12, 2013 (KR) ..... 10-2013-0154957

(51) Int. Cl.
*D06F 39/02* (2006.01)
*D06F 58/20* (2006.01)
*D06F 39/00* (2006.01)

(52) U.S. Cl.
CPC ..... *D06F 39/02* (2013.01); *D06F 39/008* (2013.01); *D06F 58/203* (2013.01)

(58) Field of Classification Search
CPC ..... D06F 39/02; D06F 39/008; D06F 58/203
See application file for complete search history.

(56) References Cited

U.S. PATENT DOCUMENTS

| | | | | |
|---|---|---|---|---|
| 7,665,332 | B2 * | 2/2010 | Wong | D06F 39/008 68/17 R |
| 7,841,219 | B2 * | 11/2010 | Wong | D06F 39/008 68/15 |
| 2009/0113745 | A1 * | 5/2009 | Choi | D06F 58/203 34/139 |
| 2009/0113755 | A1 * | 5/2009 | Choi | D06F 58/203 34/390 |
| 2009/0260406 | A1 * | 10/2009 | Bae | D06F 39/008 68/5 C |

FOREIGN PATENT DOCUMENTS

| | | | |
|---|---|---|---|
| EP | 1932963 | A1 | 6/2008 |
| EP | 2141280 | A1 | 1/2010 |
| EP | 2703543 | A1 | 3/2014 |
| WO | 2006-101360 | A1 | 9/2006 |

* cited by examiner

*Primary Examiner* — Joseph L Perrin
(74) *Attorney, Agent, or Firm* — Dentons US LLP

(57) ABSTRACT

A fabric treatment apparatus including a fabric receiving unit having a fabric receiving space formed therein, a steam spray device for supplying evaporation heat to water introduced thereinto to generate steam to be sprayed to the fabric receiving unit, and an additive supply device for receiving an additive to be dissolved in water flowing to the steam spray device, the additive supply device having a hole, through which water to be mixed with the additive is introduced, the hole being opened by fluid pressure of water flowing to the steam spray device.

27 Claims, 13 Drawing Sheets

(a)

(b)

(a)

(b)

(a)

(b)

FABRIC TREATMENT APPARATUS

CROSS-REFERENCE TO RELATED APPLICATION

This application claims priority under 35 U.S.C. §119 to Korean Application No. 10-2013-0154957, filed Dec. 12, 2013, the subject matter of which is hereby incorporated by reference.

BACKGROUND

1. Field

The present disclosure relates to an additive supply device and a fabric treatment apparatus including the same and, more particularly, to an additive supply device that is capable of selectively supplying an additive according to fluid the pressure of water and a fabric treatment apparatus including the same.

2. Background

A steam spray device is a device that applies heat to water to generate steam and sprays the generated steam. A conventional steam spray device is configured to have a structure in which water contained in a predetermined container is heated to generate steam and the generated steam is fed to a nozzle along a hose connected to the container such that the steam is sprayed from the nozzle.

When water is heated, however, scale may be generated in a flow channel formed in the steam spray device. The scale may accumulate in the flow channel to clog the flow channel. As a result, a steam output spray force may be lowered. Additionally, the scale may weaken a heat discharge ability of the steam spray device resulting in thermal deformation of the steam spray device.

SUMMARY

One object is to provide a fabric treatment apparatus that is capable of minimizing the amount of scale formed in a steam generation device.

Another object is to provide a fabric treatment apparatus that is capable of supplying an additive only when water is supplied to a steam generation device.

Yet another object is to provide a fabric treatment apparatus that is capable of uniformly maintaining the amount of an additive dissolved in water.

Still another object is to provide a fabric treatment apparatus that is capable of supplying an additive to a steam generation device only using the fluid pressure of water without an additional drive unit.

Another object is to provide a fabric treatment apparatus including an additive supply device that can be easily filled with an additive.

It should be noted that the above-mentioned objects are not limiting, and other unmentioned objects will be clearly understood by those skilled in the art from the following description.

In accordance with an aspect of the present invention, the above and other objects can be accomplished by the provision of a fabric treatment apparatus including a fabric receiving unit including a fabric receiving space formed therein, a steam spray device for supplying evaporation heat to water introduced thereinto to generate steam to be sprayed to the fabric receiving unit, and an additive supply device for receiving an additive to be dissolved in water flowing to the steam spray device, the additive supply device having an exchange hole, through which water to be mixed with the additive is introduced, the exchange hole being opened by fluid pressure of water flowing to the steam spray device.

The details of other embodiments are included in the detailed description of the invention and the accompanying drawings.

The present invention has at least one or more of the following effects.

First, the additive is supplied to water flowing to the steam spray device, thereby reducing an amount of scale generated in the steam spray device.

Second, the additive is supplied only when water flows to the steam spray device, thereby reducing the use amount of additive.

Third, the area of the additive supply device contacting water is uniform, thereby uniformly maintaining concentration of an additive dissolved in a water solution.

Fourth, the additive supply device is driven only by fluid pressure without an additional drive unit, thereby reducing power consumption and simplifying a manufacturing process.

Fifth, the additive supply device is configured to have a cartridge type structure in which the additive supply device can be easily replaced.

BRIEF DESCRIPTION OF THE DRAWINGS

Embodiments will be described in detail with reference to the following drawings in which like reference numerals refer to like elements, and wherein.

DETAILED DESCRIPTION

Advantages and features of the invention and methods for achieving the same may become apparent upon referring to the embodiments described later in detail together with attached drawings. However, embodiments are not strictly limited as disclosed hereinafter, but may be embodied in different modes. The same reference numbers may refer to the same elements throughout the specification.

In the following description, a fabric treatment apparatus is an apparatus that supplies hot air or cold air into a predetermined space, in which fabric is received, to dry the fabric. The fabric treatment apparatus includes a general dryer having a rotatable fabric receiving unit and a blower for blowing air into the fabric receiving unit, a combination washer/dryer having a drying function as well as a washing function to perform washing through the supply of water, and a refresher for unwrinkling fabric received in a cabinet and anti-bacterially treating the fabric. Hereinafter, a general dryer for supplying drying air to fabric will be described as an example of the fabric treatment apparatus for the convenience of description.

Figure 1:
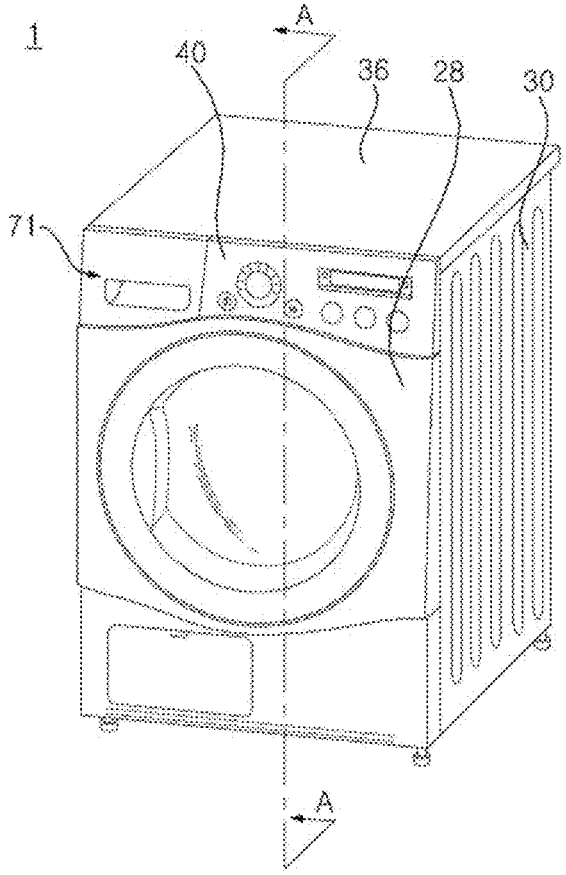
FIG. 1 is a perspective view showing a fabric treatment apparatus according to an embodiment of the present invention.
Figure 2:
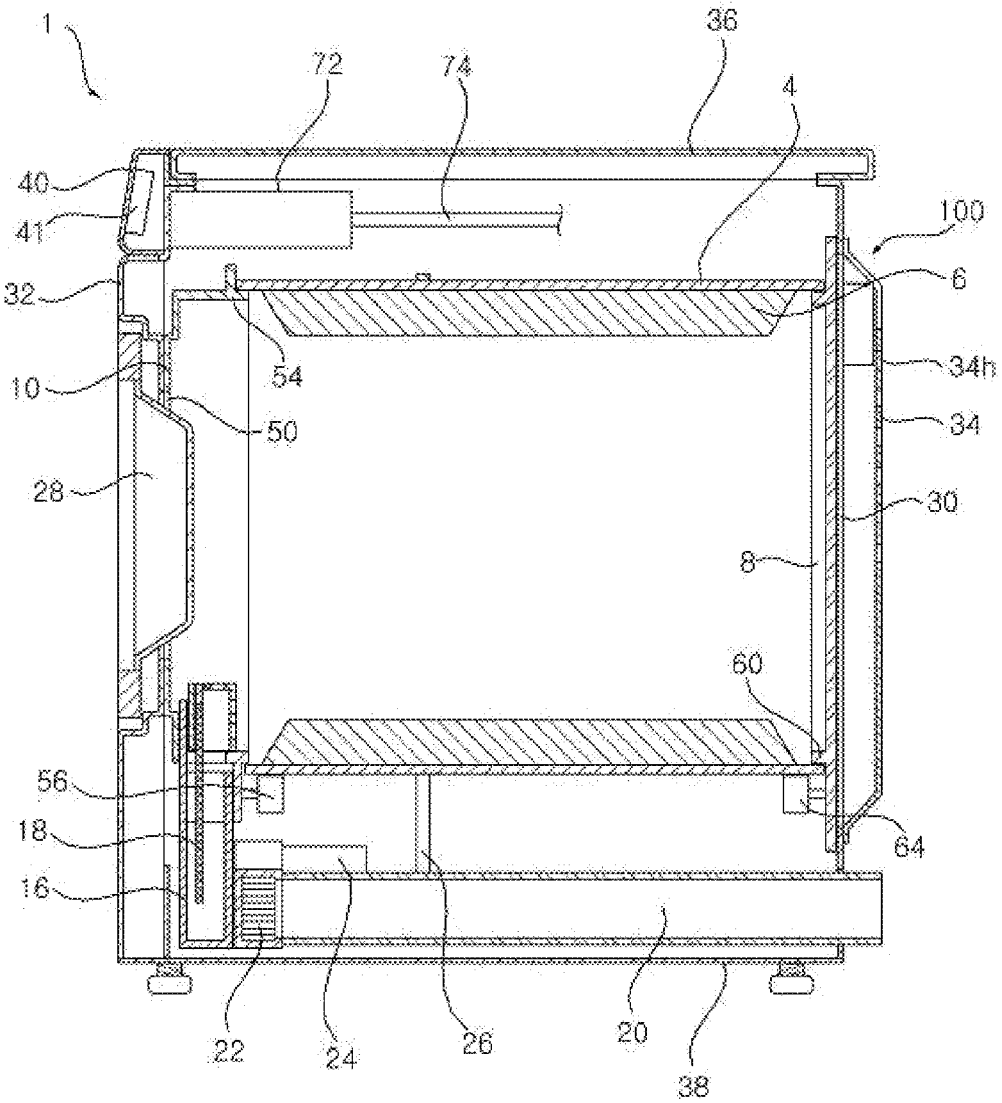
FIG. 2 is a sectional view taken along line A-A of FIG. 1.
Figure 3:
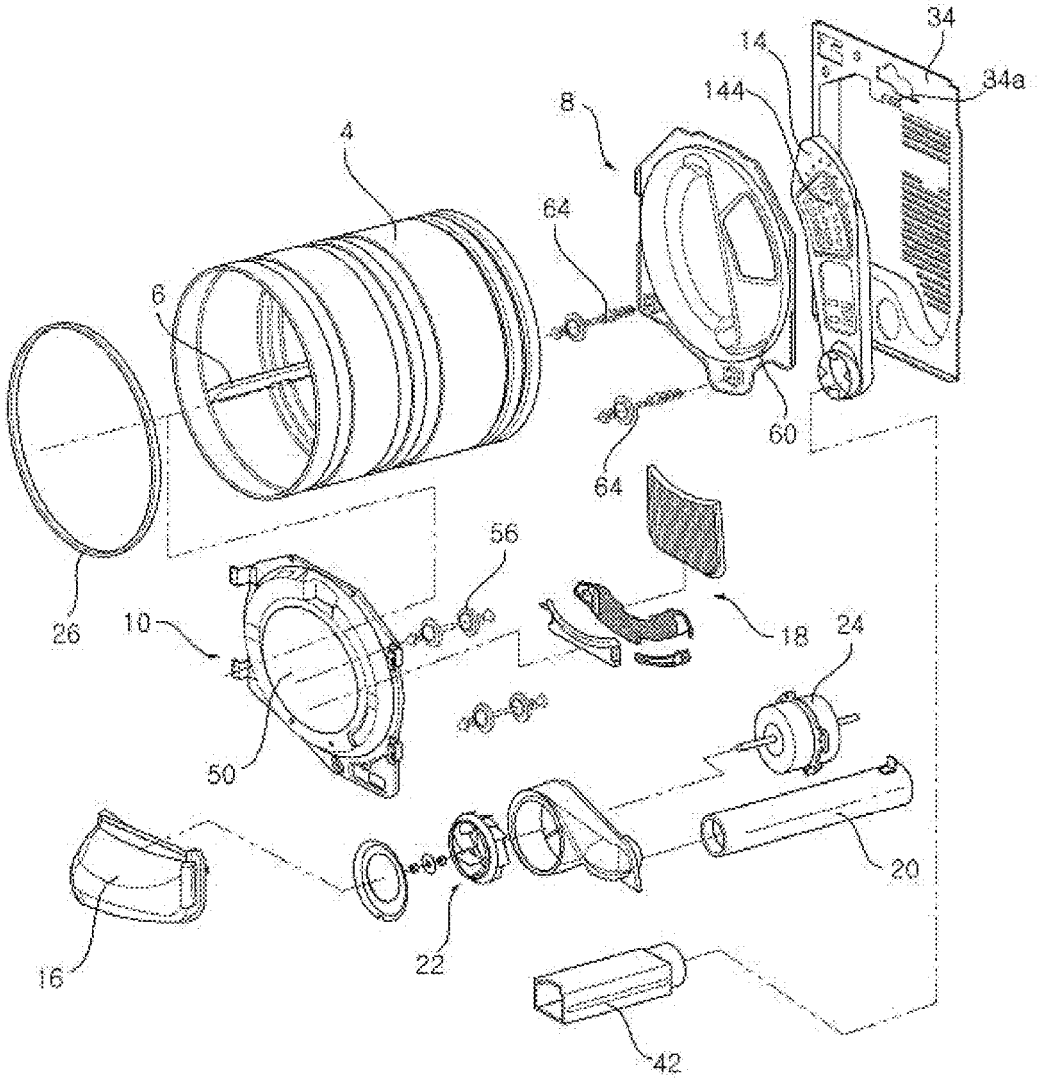
FIG. 3 is an exploded perspective view showing the fabric treatment apparatus according to the embodiment of the present invention.

FIG. 1 is a perspective view showing a fabric treatment apparatus according to an embodiment of the present invention. FIG. 2 is a sectional view taken along line A-A of FIG. 1. FIG. 3 is an exploded perspective view showing the fabric treatment apparatus according to the embodiment of the present invention.

Referring to FIGS. 1 to 3, a fabric treatment apparatus 1 according to an embodiment of the present invention includes a casing forming the external appearance of the fabric treatment apparatus and a fabric receiving unit rotatably provided in the casing for receiving fabric. Lifters 6 are provided at the inner circumference of fabric receiving unit 4 such that the fabric can be lifted and then dropped during the rotation of fabric receiving unit 4.

The casing, may include a cabinet 30, a cabinet cover 32 mounted at the front of cabinet 30, the cabinet cover 32 being provided with a fabric introduction port, at the middle thereof, a control panel 40 provided at the upper side of cabinet cover 32, a back panel 34 mounted at the rear of cabinet 30, the back panel 34 having at least on through-hole 34*h*, through which air flows into and out of the cabinet 30, a top plate 36 for covering the upper part of cabinet 30, and a base 38 mounted at the lower part of cabinet 30. A door 28 for opening and closing the fabric introduction port may be hingedly connected to cabinet cover 32.

Control panel 40 may be provided at the front of the fabric treatment apparatus 1 and includes an input unit, such as a button and/or dial, for allowing a user to input various control commands related to operation of fabric treatment apparatus 1 and a display unit, such as a liquid crystal display (LCD) and/or a light emitting diode (LED), for visually displaying operation status of fabric treatment apparatus 1. Control panel 40 may be provided at the rear of the fabric treatment apparatus 1 and includes a controller 41 for controlling overall operation of fabric treatment apparatus 1. Controller 41 may be hardware based (e.g., a microprocessor).

According to some embodiments, cabinet 30 may be provided with a water receiving unit 72 for supplying water to a steam spray device 100. A drawer 71 may be supported by cabinet 30 such that drawer 71 can be withdrawn from cabinet 30 and the water receiving unit 72 may be received in drawer 71.

A front supporter 10 and a rear supporter 8 are provided at the front part and the rear part of the casing, respectively. The front and the rear of fabric receiving unit 4 are supported by front supporter 10 and rear supporter 8, respectively.

Front supporter 10 includes an opening 50 provided at the middle of front supporter 10 and in communication with fabric introduction part. Front supporter 10 is further provided at the rear thereof with a ring-shaped front support protrusion 54 for supporting a front end of fabric receiving unit 4. In addition, front supporter 10 is provided at the lower part thereof with a front guide roller 56 which is rotatable. The inner circumference of the front end of fabric receiving unit 4 is supported by front support protrusion 54 and the outer circumference of the front end of fabric receiving unit 4 is supported by front guide roller 56.

Rear supporter 8 is provided at the front thereof with a ring-shaped rear support protrusion 60 for supporting a rear end of fabric receiving unit 4 and rear supporter 8 is provided at the lower part of the front thereof with a rear guide roller 64 which is rotatable. The inner circumference of the rear end of fabric receiving unit 4 is supported by the rear support protrusion 60 and the outer circumference of the rear end of fabric receiving unit 4 is supported by the rear guide roller 64.

Fabric receiving unit 4 is provided at lower side thereof with a drying heater 42 for heating air. A drying duct 14 is provided between rear supporter 8 and drying heater 42 such that rear supporter 8 and drying heater 42 communicate with each other via drying duct 14 for supplying the air heated by drying heater 42 into fabric receiving unit 4. Front supporter 10 is provided with a lint duct 16 such that lint duct 16 communicates with front supporter 10 allowing the air having passed through fabric receiving unit 4 to be introduced thereinto.

Drying duct 14 is provided with a plurality of through holes 144, through which air is discharged into fabric receiving unit 4. Air flows in fabric receiving unit 4 via lint duct 16, a blower 22, and an exhaust duct 20 due to blowing force generated by blower 22. Particularly, in the flowing process of the air, the air heated by drying heater 42 flows along drying duct 14 and is then discharged into fabric receiving unit 4 through the through holes 144.

Additionally, the air introduced into lint duct 16 is purified by a filter 18. The casing is provided at the rear thereof with an exhaust duct 20 for guiding the air from lint duct 16 to the outside of the casing.

Blower 22 is connected between the exhaust duct 20 and lint duct 16. Fabric treatment apparatus 1 further includes a motor 24 for generating the driving force of the blower 22. A transmission belt 26 interlocked with the motor for transmitting a driving force of motor 24 to rotate fabric receiving unit 4.

Figure 4:
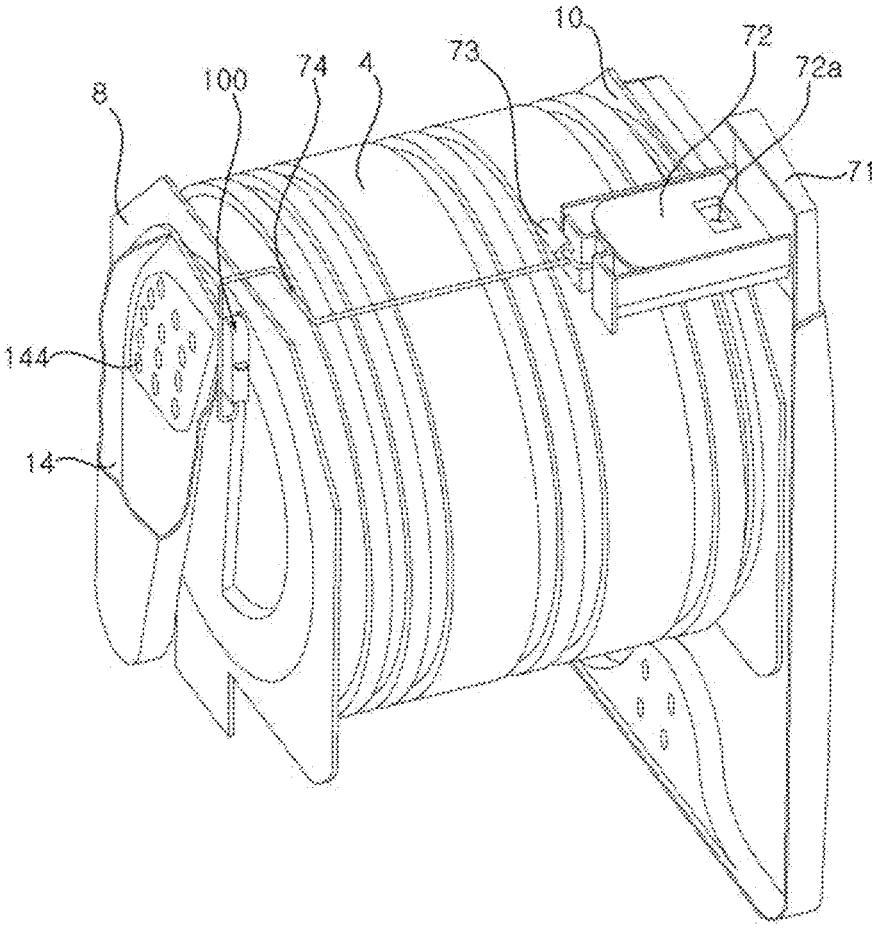
FIG. 4 is a perspective view showing the interior of the fabric treatment apparatus including a steam spray device according to an embodiment of the present invention.
Figure 5A:
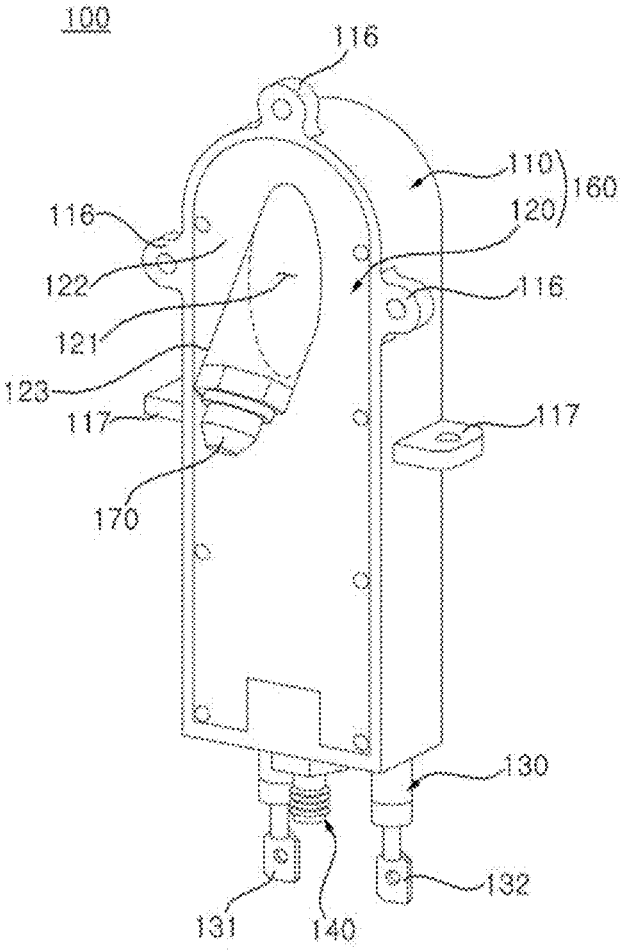
FIG. 5A is a perspective view showing the steam spray device according to an embodiment of the present invention.
Figure 5B:
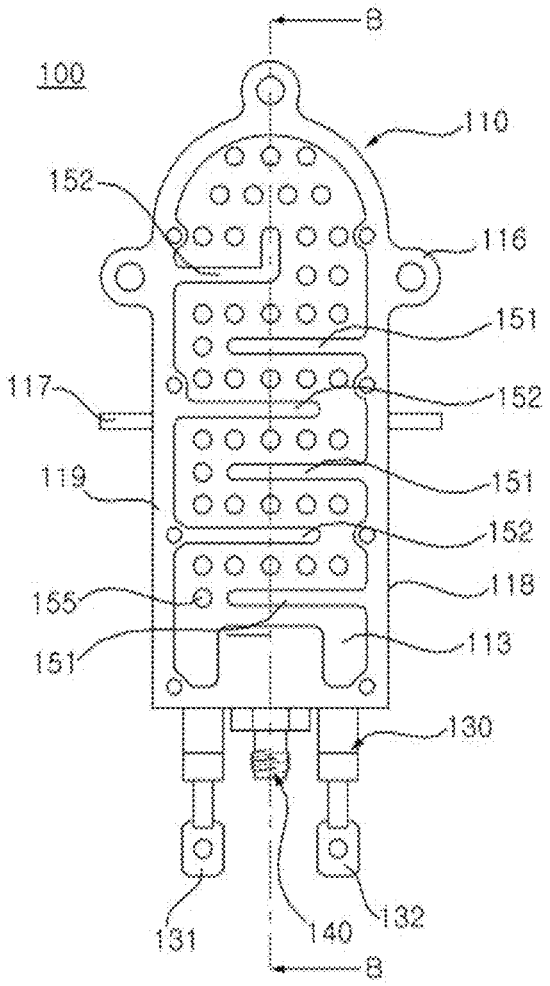
FIG. 5B is a view showing a flow channel forming unit of the steam spray device according to an embodiment of the present invention.
Figure 5C:
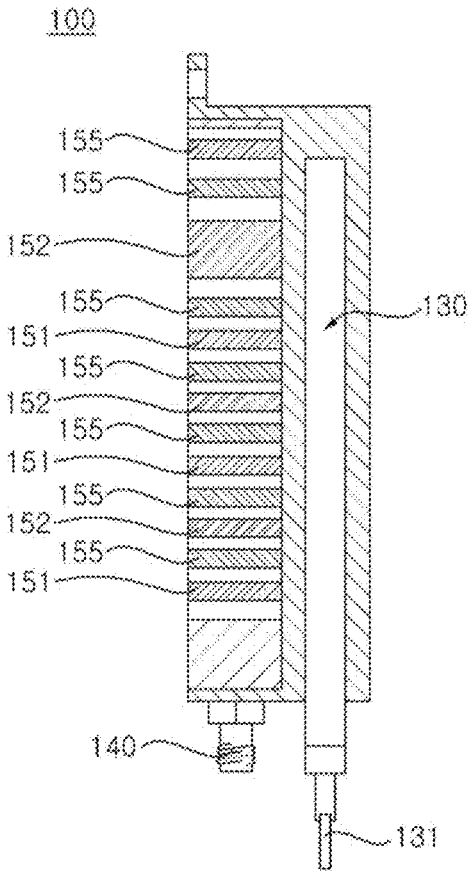
FIG. 5C is a sectional view taken along line B-B of FIG. 5B.

FIG. 4 is a perspective view showing the interior of the fabric treatment apparatus including the steam spray device. FIG. 5A is a perspective view showing the steam spray device. FIG. 5B is a view showing a flow channel forming unit of the steam spray device. FIG. 5C is a sectional view taken along line B-B of FIG. 5B.

Referring to FIGS. 4 and 5A-5C, the steam spray device 100 is a device for spraying water into fabric receiving unit 4. Steam spray device 100 includes a flow channel forming unit 160 having a flow channel, along which water introduced through an introduction port 140 is guided to a discharge port 121, formed therein, a steam generation heater 130 for applying heat to the water flowing along the flow channel formed in flow channel forming unit 160, and a nozzle 170 for spraying steam generated by a heating operation of steam generation heater 130 at a predetermined pressure.

In one embodiment, water receiving unit 72 is provided. Alternatively, flow channel forming unit 160 may directly receive water from an external water source, such as a tap. For example, a water supply hose connected to the external water source may be connected to introduction port 140, a valve for regulating the supply of water may be further provided between introduction port 140 and the water supply hose, and a filter for filtering foreign matter from the supplied water may be further provided.

In this embodiment, introduction port 140 is connected to water receiving unit 72 via a water supply pipe 74, and a pump 73 is provided for forcibly feeding water from the water receiving unit 72 to flow channel forming unit 160 is provided.

Flow channel forming unit 160 and nozzle 170 may be integrally coupled to each other. Integral coupling between flow channel forming unit 160 and nozzle 170 includes a case in which flow channel forming unit 160 and nozzle 170 are formed as separate members and are then coupled to each other to constitute a single unit or module, and a case in which flow channel forming unit 160 and the nozzle 170 are formed as a single member by injection molding. Regardless of the coupling method, the position of nozzle 170 may be decided based on the fixed position of flow channel forming unit 160.

In a conventional structure in which water contained in a predetermined container is heated to generate steam and the generated steam is fed to a nozzle along a hose, the steam is condensed during flow along the hose. As a result, the condensed water is sprayed through the nozzle, wetting the previously dried articles. Conversely, in this embodiment of the present invention, water is heated to generate steam while flowing along flow channel forming unit 160, and the steam is sprayed through nozzle 170 integrally formed at flow channel forming unit 160. Consequently, it is possible to fundamentally prevent the occurrence of a phenomenon in which the steam generated in flow channel forming unit 160 is condensed while being supplied to nozzle 170.

Water receiving unit 72 is provided in drawer 71. A user may withdraw drawer 71 and supply water into the water receiving unit 72 through an introduction port 72*a* formed at water receiving unit 72. In particular, for a fabric treatment apparatus miniaturized in consideration of mobility, the structure in which water is supplied through water receiving unit 72 is more advantageous than the structure in which water is supplied through the external water source.

Flow channel forming unit 160 may include a flow channel body 110 having a flow channel, along which water is guided from introduction port 140 to discharge port 121, formed therein, the flow channel body 110 being open at the upper part thereof, and a cover 120 for covering the open upper part of flow channel body 110. According to some embodiments, flow channel body 110 and the cover 120 may be integrally formed. Introduction port 140, which is connected to water supply pipe 74, is formed at flow channel body 110. Consequently, water is introduced into flow channel body 110 through the introduction port 140.

Steam generation heater 130 is provided to heat water introduced into flow channel body 110, to generate steam. Steam generation heater 130 may be provided in a flow channel, along which water flows, in an exposed state. In this embodiment, steam generation heater 130 is embedded in a bottom 113 of the flow channel body 110. Since steam generation heater 130 is not directly exposed to water, it is not necessary to provide an additional insulation structure for insulating steam generation heater 130. Flow channel body 110 may be made of a thermally conductive material, such as aluminum, such that heat can be easily transferred from steam generation heater 130 to flow channel body 110.

Steam generation heater 130 may include two terminals 131 and 132 for supplying power. The terminals protrude outwardly from flow channel body 110 so that the terminals may be electrically connected to a power source.

Flow channel body 110 has a predetermined space, along which water moves, formed therein. A plurality of flow channel forming ribs 151 and 152 are formed at the bottom 113 of flow channel body 110 and protrude away from the bottom 1143. The flow channel forming ribs 151 and 152 define water moving channels. The flow channel forming ribs 151 and 152 also extend from sides 118 and 119, respectively, of the flow channel body 110.

Flow channel forming ribs 151 and 152 include first flow channel forming ribs 151 extending from right side 118 of the flow channel body 110 and second flow channel forming ribs 152 extending from a left side 119 of the flow channel body 110. The first flow channel forming ribs 151 and the second flow channel forming ribs 152 are alternately arranged between introduction port 140 and nozzle 170.

An end of each of the first flow channel forming ribs 151 is spaced apart from the left side 119 of the flow channel body 110 by a predetermined distance. In the same manner, an end of each of the second flow channel forming ribs 152 is spaced apart from the right side 118 of the flow channel body 110 by a predetermined distance. Water, supplied through introduction port 140, is guided along a flow channel defined between flow channel forming ribs 151 and 152. The movement direction of the water is alternately changed during movement of the water toward nozzle 170.

Cover 120 covers flow channel body 110. Cover 120 may be integrally formed at the flow channel body 110. Alternatively, cover 120 may be coupled to flow channel body 110 by fastening members, such as screws or bolts. At this time, airtightness may be achieved between cover 120 and flow channel body 110 to prevent leakage of steam generated in flow channel body 110.

Cover 120 may include a plate body 122 for covering the flow channel body 110 and a guide pipe 123 extending from a discharge port 121 formed at plate body 122 for guiding steam generated in flow channel body 110 to the nozzle 170. Nozzle 170 is coupled to an end of guide pipe 123.

Meanwhile, a plurality of fastening parts 116 and 117 may be formed at flow channel body 110. Each of the fastening parts is provided with a fastening hole, through which a fastening member for fixing the flow channel body 110 is fastened. It is possible to form the fastening holes such that the fastening holes have different opening directions in consideration of various installation structures. In this embodiment, the opening direction of the fastening holes formed at the first fastening parts 116 is different from the opening direction of the fastening holes formed at the second fastening parts 117.

Meanwhile, a plurality of heat transfer protrusions 155 may be formed between first flow channel forming ribs 151 and second flow channel forming ribs 152 such that heat transfer protrusions 155 protrude from the bottom 113 of flow channel body 110. The heat transfer protrusions 155 are disposed such that the heat transfer protrusions 155 are spaced apart from each other by a predetermined distance. When heat is emitted from steam generation heater 130, bottom 113 of the flow channel body 110 is heated, and the flow channel forming ribs 151 and 152 and heat transfer protrusions 155 are also heated. In this structure, the emission area of heat transferred from steam generation heater 130 is large. Consequently, water moving along the flow channel defined between flow channel forming ribs 151 and 152 is phase-changed into steam at a high speed.

When the flow channel body 110, particularly bottom 113, is made of a thermally conductive material, a heating effect achieved by the flow channel forming ribs 151 and 152 and heat transfer protrusions 155 is improved.

In the structure in which the movement direction of the water is alternately changed along the flow channel defined between flow channel forming ribs 151 and 152 as described above, the movement distance of the water is increased with the result that sufficient heat can be applied to the water moving along the flow channel. Furthermore, the water can be sufficiently heated until the water reaches nozzle 170 in consideration of the heating effect achieved by heat transfer protrusions 155. In comparison with a case in which water necessary to generate steam is collected in a predetermined space and the water is heated to generate steam, this embodiment has an advantage in that heat is applied to moving water and thus a phase change of the water is almost immediately performed, whereby it is possible to reduce the time period necessary to spray steam as compared with the conventional art.

Additionally, since the water is heated during movement of the water along the flow channel formed in flow channel forming unit 160, pressure applied to the water is gradually increased from an upper stream to a lower stream with the result being that high-pressure steam may be sprayed through nozzle 170. In particular, pressure generated by movement of the water from introduction port 140 to discharge port 121 as well as pressure increased by the steam is applied to discharge port 121. Consequently, the spray pressure of nozzle 170 is further increased.

During spraying of the steam through nozzle 170, the temperature at discharge port 121 or the inlet of nozzle 170 is about 70° C. or less and the temperature in fabric receiving unit 4 is maintained at 30° C. to 40° C. If the temperature of the steam applied to fabric is too high, the fabric may be directly damaged and, in addition, secondary contamination may occur due to denaturalization of stains on the fabric. In this embodiment, on the other hand, the temperature in fabric receiving unit 4 is maintained at 30° C. to 40° C. although the steam is sprayed through nozzle 170 at a predetermined pressure or higher with the result that it is possible to prevent damage to the fabric.

Figure 6:
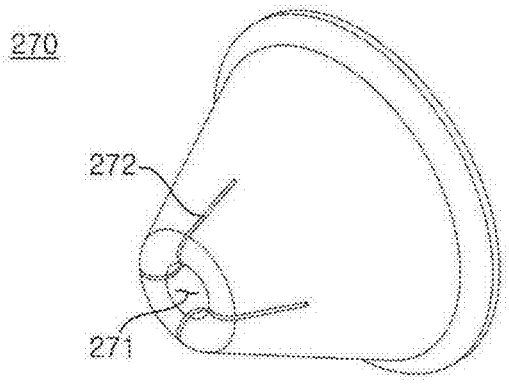
FIG. 6 is a graph showing spray pressure of a nozzle based on a spray diameter of the nozzle according to an embodiment of the present invention.

The spray pressure of nozzle 170 is closely related to the diameter of a spray port. Referring to FIG. 6, the diameter of the spray port of nozzle 170 may be changed in a state in which other conditions are not changed to measure the spray pressure of nozzle 170. In a case in which the diameter of the spray port is greater than 1.5 mm, water sprayed through nozzle 170 does not strike fabric with sufficient intensity or does not reach the fabric at all. In a case in which the diameter of the spray port is less than 1 mm, on the other hand, the amount of water sprayed through nozzle 170 is insufficient to treat the fabric. Additionally, the less the diameter of the spray port is, the more easily the spray port may be clogged due to scale. Consequently, the diameter of the spray port of nozzle 170 may be about 1.5 to 2 mm in consideration of various effects. At this time, nozzle 170 may spray 70 to 120 cc of water per minute.

Additionally, since the water moves along the narrow flow channel defined between flow channel forming ribs 151 and 152 and the water continuously absorbs heat during the movement of the water, the water in the lower stream in the direction in which the water moves from introduction port 140 to the nozzle has a long time for absorbing heat and, therefore, the change in phase of the water can be easily achieved. The water in the upper stream is rapidly heated by bottom 113 of the of the flow channel body 110 to generate steam. Furthermore, fluid pressure generated due to the movement of the water is applied with the result that the water becomes a high temperature and high-pressure state and, therefore, high-pressure is applied from the upper stream to the lower stream. Consequently, the steam finally sprayed through nozzle 170 may reach the fabric in fabric receiving unit 4 in a state in which the steam is maintained at a very high pressure.

That is, steam spray device 100 according to the embodiment of the present invention generates and sprays steam within a short period of time. Consequently, it is possible to reduce time necessary to perform a steam spray process, thereby reducing power consumption, and to spray high-pressure steam.

Figure 7:
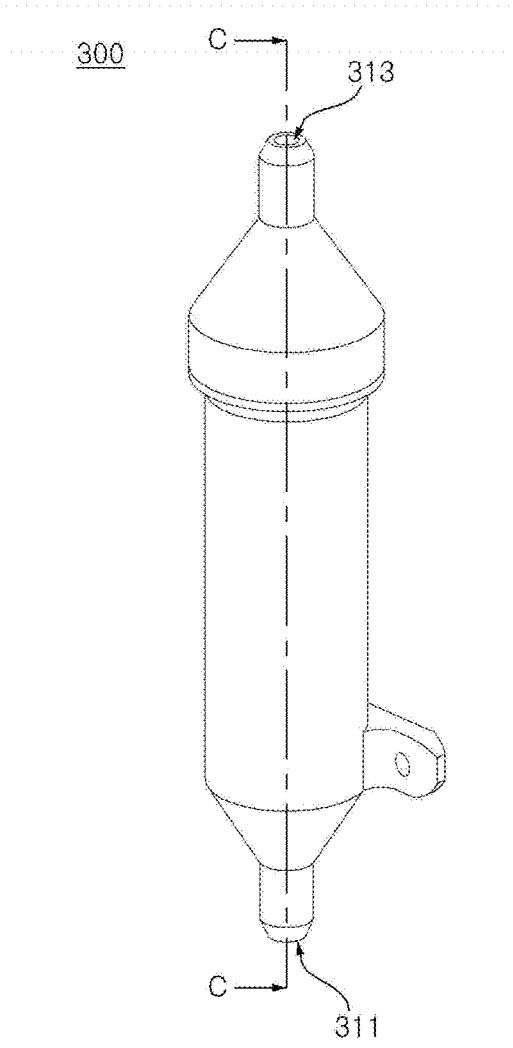
FIG. 7 is a perspective view showing an additive supply device according to an embodiment of the present invention.

FIG. 7 is a perspective view showing an additive supply device according to an embodiment of the present invention.

Referring to FIG. 7, the fabric treatment apparatus 1 according to one embodiment of the present invention includes fabric receiving unit 4 having the fabric receiving space formed therein, steam spray device 100 for supplying evaporation heat to water introduced thereinto to generate steam to be sprayed to fabric receiving unit 4, and an additive supply device 300 for receiving an additive to be dissolved in water flowing to the steam spray device 100, the additive supply device 300 having an exchange hole 361, through which water to be mixed with the additive is introduced, exchange hole 361 being opened by fluid pressure of water flowing to steam spray device 100.

Steam spray device 100 applies heat to water such that the water can be evaporated. The water is evaporated in steam spray device 100 such that the water can be phase-changed into steam. The steam is sprayed into fabric receiving unit 4 through a nozzle 270. The additive flows to steam spray device 100 together with the water.

The fluid pressure is the pressure of water flowing to steam spray device 100. The fluid pressure moves a cartridge 350 of the additive supply device 300. Exchange hole 361 is formed at the additive supply device 300. Water flows into an additive receiving space 350S through exchange hole 361.

An additive supply device 300 according to an embodiment of the present invention includes a housing 310 having an inlet 311, through which water is introduced, and an outlet 313, through which water is discharged to steam spray device 100, and a cartridge 350 for receiving an additive, cartridge 350 having an exchange hole 361, cartridge 350 being moved from inlet 311 to output port 313 by fluid pressure.

Inlet 311 and outlet 313 are formed at the housing 310. Water is introduced through inlet 311 and discharged through the outlet 313. Cartridge 350 is disposed in the housing 310. Cartridge 350 is moved by the fluid pressure. Exchange hole 361 is formed at the cartridge 350. The additive is received in cartridge 350. The additive may contain an anti-scaling agent, which will hereinafter be described. Water introduced through exchange hole 361 dissolves the additive. A water solution containing an additive dissolved therein is discharged through exchange hole 361. The water solution is diffused outward through exchange hole 361. Cartridge 350 can be moved in the housing 310. Exchange hole 361 may be opened by the fluid pressure.

Consequently, it is possible to control the additive supply device 300 using the fluid pressure. Additive supply device 300 does not need additional driving force except for the fluid pressure, thereby reducing power consumption. In addition, generation of scale in steam spray device 100 is reduced, thereby achieving uniform spray of steam. The scale may narrow or clog the flow channel formed in steam spray device 100. When this occurs, steam spray device 100 may be thermally deformed or burnt by fire since steam spray device 100 is continuously heated. However, additive supply device 300 also discharges an anti-scaling material, thereby solving the above problems.

Figure 8:
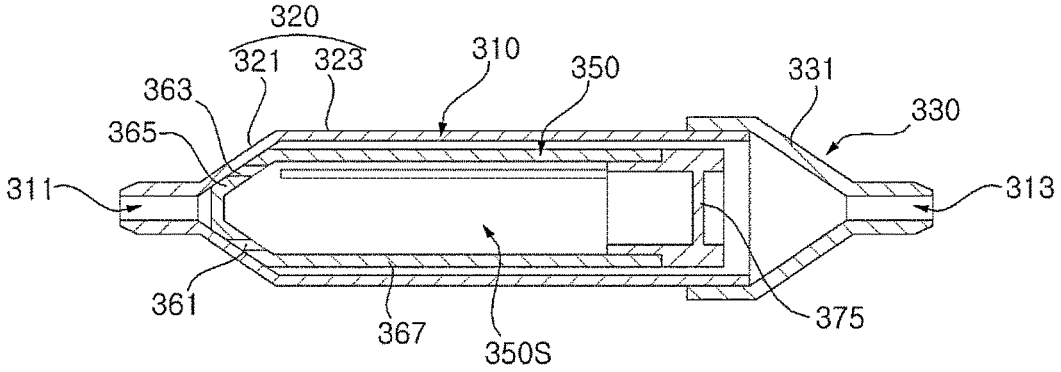
FIG. 8 is a sectional view taken along line C-C of FIG. 7 showing an operation state of the additive supply device.
Figure 8:
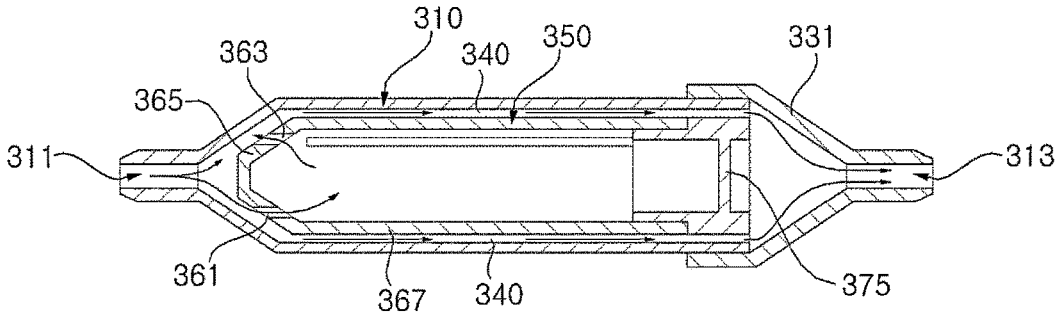
Figure 9:
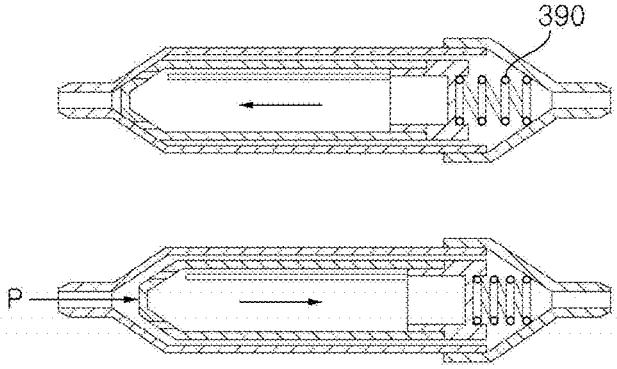
FIG. 9 is a view showing a returning principle of the additive supply device according to an embodiment of the present invention.
Figure 9:
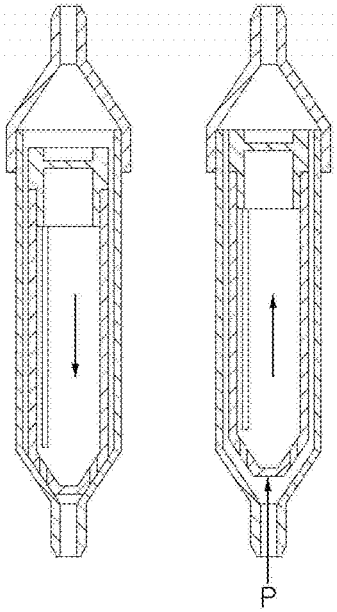
Figure 12:
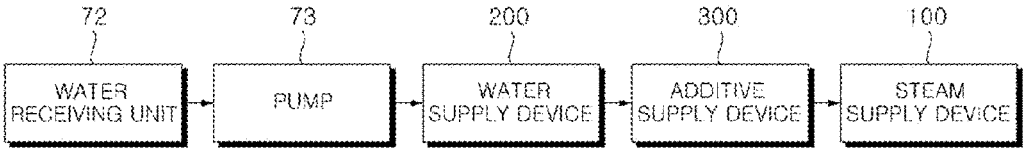
FIG. 12 is a block diagram schematically showing a flow route of water according to an embodiment of the present invention.

FIG. 8 is a sectional view taken along line C-C of FIG. 7 showing an operation state of additive supply device 300. FIG. 9 is a view showing a returning principle of additive supply device 300. FIG. 12 is a block diagram schematically showing a flow route of water.

Referring to FIGS. 8, 9, and 12, the fabric treatment apparatus 1 according to the embodiment of the present invention further includes a water supply valve 200 for regulating water to be supplied to additive supply device 300. When water supply valve 200 is opened, additive supply device 300 discharges the anti-scaling agent.

When water supply valve 200 is opened, water is supplied into additive supply device 300. When water supply valve 200 is opened, fluid pressure applied to additive supply device 300 is increased. Housing 310 has a space formed therein, in which cartridge 350 is disposed such that cartridge 350 can be reciprocated. Housing 310 has a space, in which an elastic member 390, which will hereinafter be described, is disposed, formed therein. When the fluid pressure is increased, cartridge 350 is moved to outlet 313. An inlet forming part 321 and an inlet opposite part 365 are spaced apart from each other. Exchange hole 361, formed at inlet opposite part 365, is opened. When the fluid pressure is increased to such an extent that the elastic force of elastic member 390 can be overcome, exchange hole 361 is opened.

When the fluid pressure is decreased, cartridge 350 is moved to inlet 311. Inlet forming part 321 and inlet opposite part 365 come into contact with each other. Exchange hole 361, formed at inlet opposite part 365, is then closed. That is when the elastic force of elastic member 390 overcomes the fluid pressure, exchange hole 361 is closed. Elastic member 390 may be disposed between an outlet forming part 331 and an outlet opposite part 375.

In another embodiment, housing 310 and the cartridge 350 may be disposed such that cartridge 350 can be reciprocated upward and downward. When the fluid pressure is increased to such an extent that gravity applied to cartridge 350 can be overcome, exchange hole 361 is opened. When the gravity applied to cartridge 350 overcomes the fluid pressure, exchange hole 361 is closed.

Additive supply device 300 according to the embodiment of the present invention is disposed between water supply valve 200 and steam spray device 100. Water receiving unit 72 is connected to pump 73. Pump 73 forcibly feeds water to water supply valve 200. Water supply valve 200 regulates water to be supplied to additive supply device 300. Water supply valve 200 adjusts fluid pressure applied to the additive supply device 300.

When water supply valve 200 is opened, cartridge 350 is moved and the spray of steam is commenced. When water supply valve 200 is closed, the cartridge 350 returns to the original position thereof and the spray of steam of stopped. Consequently, it is possible to control the spray of steam and the supply of the additive through additive supply device 300 only by manipulating water supply valve 200.

FIG. 7 is a perspective view showing an additive supply device according to an embodiment of the present invention.

Referring to FIG. 7, additive supply device 300 according to the embodiment of the present invention includes a housing 310 having an inlet 311, through which water is introduced, and an outlet 313, through which water is discharged to steam spray device 100, and a cartridge 350 disposed in housing 310 for receiving an additive, cartridge 350 having an exchange hole 361, through which water is introduced, cartridge 350 being moved in housing 310 by fluid pressure of water introduced into housing 310 for opening exchange hole 361.

Inlet 311 and outlet 313 are formed at housing 310. Water is introduced through inlet 311 and discharged through outlet 313. Cartridge 350 is disposed in housing 310. Cartridge 350 is moved by the fluid pressure. Exchange hole 361 is formed at cartridge 350. The additive is received in cartridge 350. The additive may contain an anti-scaling agent, which will hereinafter be described. Water introduced through exchange hole 361 dissolves the additive. A water solution containing an additive dissolved therein is discharged through the exchange hole 361. The water solution is diffused outward through exchange hole 361. Cartridge 350 can be moved in housing 310. Exchange hole 361 may be opened by the fluid pressure. Consequently, it is possible to operate additive supply device 300 only using the fluid pressure without additional driving force, thereby reducing power consumption.

FIG. 8 is a sectional view taken along line C-C of FIG. 7 showing an operation state of the additive supply device 300. Referring to FIG. 8, in an embodiment of the present invention, cartridge 350 includes an inlet opposite part 365 facing an inlet 311, an outlet opposite part 375 facing an outlet 313, and a middle cartridge part 367 disposed between inlet opposite part 365 and the outlet opposite part 375. Housing 310 includes an inlet forming part 321 facing the inlet opposite part 365, inlet 311 being formed at inlet forming part 321, an outlet forming part 331 facing outlet opposite part 375, outlet 313 being formed at outlet forming part 331, and a middle housing part 323 disposed between inlet forming part 321 and outlet forming part 331.

The inlet opposite part 365 is disposed such that inlet opposite part 365 faces inlet 311. The outlet opposite part 375 is disposed such that outlet opposite part 375 faces outlet 313. Water introduced through inlet 311 collides against the inlet opposite part 365. Middle cartridge part 367 is disposed between inlet opposite part 365 and outlet opposite part 375. Middle cartridge part 367 may be formed in a cylindrical shape.

Inlet forming part 321 is disposed such that inlet forming part 321 faces inlet opposite part 365. Inlet opposite part 365 may be moved such that inlet opposite part 365 comes into contact with inlet forming part 321. When inlet opposite part 365 and inlet forming part 321 come into contact with each other, an exchange hole 361 is closed. When inlet opposite part 365 and inlet forming part 321 are spaced apart from each other, exchange hole 361 is opened.

Middle housing part 323 is disposed between inlet forming part 321 and outlet forming part 331. Middle housing part 323 is approximately identical in shape to middle cartridge part 367 except that size of the middle housing part 323 is different from the size of middle cartridge part 367. An additive receiving space 350S is formed in cartridge 350.

In an embodiment of the present invention, exchange hole 361 is formed at inlet opposite part 365. The inlet opposite part 365 may be disposed such that inlet opposite part 365 faces inlet 311. Exchange hole 361 may be located such that exchange hole 361 faces the inlet forming part 321. Water introduced through inlet 311 may be introduced into exchange hole 361. The water introduced into exchange hole 361 may be mixed with an additive. A water solution containing an additive dissolved therein may be diffused through exchange hole 361.

In an embodiment of the present invention, inlet opposite part 365 is provided with an air flowing hole 363, through which air is discharged from the cartridge 350. Air flowing hole 363 is formed at the inlet opposite part 365. Inlet opposite part 365 may be located such that the inlet opposite part 365 faces inlet 311. Air flowing hole 363 may be located such that the air flowing hole 363 faces inlet forming part 321. Water introduced through exchange hole 361 may be discharged through air flowing hole 363. Additionally, air generated in cartridge 350 may be discharged through the air flowing hole 363. The water solution or the air discharged through air flowing hole 363 flows to outlet 313 together with the water.

In an embodiment of the present invention, a middle flow channel 340, along which water flows, is formed between middle cartridge part 367 and middle housing part 323. A gap is provided between middle cartridge part 367 and middle housing part 323. Water flowing along middle flow channel 340 is water mixed with the water solution containing the additive. The water discharged from middle flow channel 340 is directed to outlet 313. The inner diameter of the middle housing part 323 is greater than the outer diameter of the middle cartridge part 367.

In an embodiment of the present invention, housing 310 is configured such that cartridge 350 can be reciprocated between inlet 311 and outlet 313. Housing 310 is provided with a space in which cartridge 350 can be reciprocated. In addition, housing 310 is provided with a space in which an elastic member 390, which will hereinafter be described, is disposed.

Figure 10:
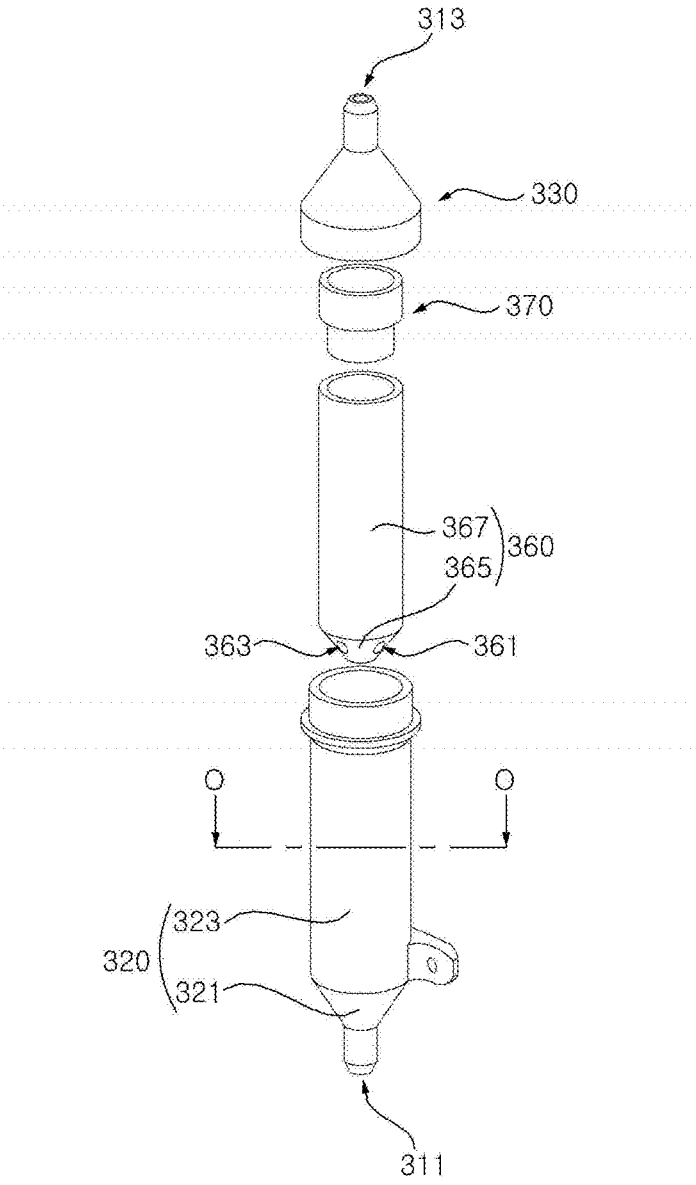
FIG. 10 is an exploded perspective view showing the additive supply device according to the embodiment of the present invention.
Figure 11:
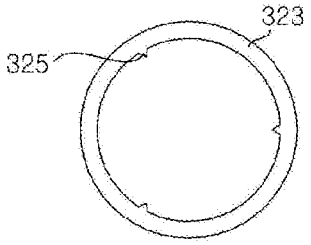
FIG. 11 is a sectional view taken along line O-O of FIG. 10.

FIG. 9 is a view showing a returning principle of the additive supply device 300. FIG. 10 is an exploded perspective view showing additive supply device 300 according to an embodiment of the present invention.

Referring to FIG. 9(*a*), additive supply device 300 according to an embodiment of the present invention further includes an elastic member 390 for pushing cartridge 350 such that cartridge 350 comes into contact with the inner wall of housing 310 to close exchange hole 361 and being pushed by fluid pressure to open exchange hole 361.

When the fluid pressure is increased, cartridge 350 is moved to outlet 313. Inlet forming part 321 and inlet opposite part 365 are spaced apart from each other. Exchange hole 361, formed at the inlet opposite part 365, is opened. When the fluid pressure is increased to such an extent that elastic force of elastic member 390 can be overcome, exchange hole 361 is opened.

When the fluid pressure is decreased, cartridge 350 is moved to inlet 311. Inlet forming part 321 and inlet opposite part 365 come into contact with each other. Exchange hole 361, formed at the inlet opposite part 365, is closed. When the elastic force of elastic member 390 overcomes the fluid pressure, exchange hole 361 is closed. Elastic member 390 may be disposed between outlet forming part 331 and outlet opposite part 375.

Referring to FIG. 9(*b*), housing 310 and the cartridge 350 may be disposed such that cartridge 350 can be reciprocated upward and downward. When the fluid pressure is increased, cartridge 350 is moved upward to open exchange hole 361. On the other hand, when the fluid pressure is decreased, cartridge 350 is moved downward to close exchange hole 361. When the fluid pressure is increased to such an extent that gravity applied to cartridge 350 can be overcome, exchange hole 361 is opened. When the gravity applied to cartridge 350 overcomes the fluid pressure, exchange hole 361 is closed.

Housing 310 includes a housing body 320 for receiving cartridge 350, inlet 311 being formed at housing body 320 and a housing cap 330 detachably coupled to the housing body 320, outlet 313 being formed at housing cap 330.

Housing body 320 may be constituted by inlet forming part 321 and middle housing part 323. Housing cap 330 may be constituted by outlet forming part 331. A screw thread may be formed at housing body 320 and/or the housing cap 330. Housing body 320 and housing cap 330 may be coupled to each other by screw engagement. A sealing member may be provided between housing body 320 and housing cap 330 for sealing between housing body 320 and housing cap 330. The sealing member may be an O-ring. Since housing 310 includes housing body 320 and housing cap 330, it is possible to easily replace cartridge 350.

Cartridge 350 includes a cartridge body 360 having an additive receiving space formed therein, exchange hole 361 being formed at the cartridge body 360, and a cartridge cap 370 for covering cartridge body 360.

Cartridge body 360 includes the inlet opposite part 365 and the middle cartridge part 367. The interior of cartridge body 360 is filled with an additive. The additive is dissolved in water introduced through exchange hole 361. Exchange hole 361 is located adjacent to inlet 311. Cartridge cap 370 is disposed adjacent to outlet 313. Cartridge cap 370 includes an outlet opposite part. Since cartridge 350 includes cartridge body 360 and cartridge cap 370, it is possible to easily fill cartridge 350 with an additive.

The additive removes materials dissolved in water. For example, the additive may remove calcium salt or magnesium salt contained in water by precipitation. The additive may remove a hard component contained in water such that the water is changed into soft water. The additive is an anti-scaling material. Cartridge 350 defines an additive receiving space 360S.

Cartridge 350 is provided with an air flowing hole 363. Air flowing hole 363 is located higher than exchange hole 361. Air flowing hole 363 is formed at the cartridge 350. Air in the cartridge 350 is discharged out of cartridge 350 through air flowing hole 363. Air rises in cartridge 350. Air flowing hole 363 may be located higher than exchange hole 361. Exchange hole 361 and air flowing hole 363 may be distinguished from each other based on positions of exchange hole 361 and air flowing hole 363. In a case in which the positions of exchange hole 361 and air flowing hole 363 are exchanged with each other, functions of exchange hole 361 and air flowing hole 363 are changed. The positions of exchange hole 361 and air flowing hole 363 may be fixed so as to uniformly maintain a diffusion degree.

At least one of the middle cartridge part 367 and the middle housing part 323 is provided with a guide rail 325 for restraining rotation of cartridge 350. In a case in which guide rail 325 is formed at the middle cartridge part 367, a guide groove is formed at the middle housing part 323. In a case in which guide rail 325 is formed at the middle housing part 323, on the other hand, the guide groove is formed at the middle cartridge part 367. Cartridge 350 may be reciprocated along guide rail 325. Guide rail 325 may be formed in parallel to a line interconnecting inlet 311 and outlet 313. When the fluid pressure is increased, cartridge 350 is moved to outlet 313 along guide rail 325. When the fluid pressure is decreased, on the other hand, cartridge 350 is moved to inlet 311 along guide rail 325. Guide rail 325 prevents rotation of cartridge 350. Exchange hole 361 and air flowing hole 363 may be different in size or position from each other. Consequently, guide rail 325 functions to uniformly maintain a dissolving degree of the additive and concentration of the water solution.

Although embodiments have been described herein with reference to a number of illustrative embodiments thereof, it should be understood that numerous other modifications and embodiments can be envisioned by those skilled in the art that will fall within the spirit and scope of the principles of this disclosure. More particularly, various variations and modifications are possible in the component parts and/or arrangements of the subject combination arrangement within the scope of the disclosure, the drawings, and the appended claims. In addition to variations and modifications in the component parts and/or arrangements, alternative uses will also be apparent to those skilled in the art.

What is claimed is:

1. A fabric treatment apparatus comprising:

a fabric receiving unit including a fabric receiving space formed therein;

a steam spray device for spraying steam into the fabric receiving unit; and an additive supply device for supplying an additive to water, wherein the additive supply device comprises:

a housing having an inlet, through which water is introduced, and an outlet, through which the water introduced through the inlet is discharged to the steam spray device;

a cartridge having an additive receiving space formed therein, the cartridge being disposed in the housing such that the cartridge can be moved by water pressure for opening and closing the inlet; and an elastic member disposed in the housing for applying elastic force to the cartridge such that the cartridge is moved to the inlet, wherein the cartridge is provided with a first hole, through which the additive receiving space communicates with a space defined between the housing and the cartridge, and wherein the first hole is closed by contact with the housing when the water pressure is insufficient to move the cartridge and is spaced apart from the housing and thus opened when the cartridge is moved by the water pressure.

2. The fabric treatment apparatus claim 1, wherein the housing comprises:

an inlet forming part for opening and closing the first hole, the inlet forming part comprising the inlet;

an outlet forming part comprising the outlet; and a tubular middle housing part extending between the inlet forming part and the outlet forming part.

3. The fabric treatment apparatus of claim 2, wherein the cartridge comprises a middle cartridge part corresponding to the middle housing part, and one part selected from the middle housing part and the middle cartridge part is provided with a guide rail extending in a direction in which the cartridge is moved and the other part is provided with a guide groove associated with the guide rail for restraining rotation of the cartridge.

4. The fabric treatment apparatus of claim 2, wherein the first hole is formed at a part of the cartridge opposite to the inlet forming part.

5. The fabric treatment apparatus of claim 4, wherein the inlet forming part is formed in a conical shape in which an inner space of the inlet forming part is gradually widened from the inlet, and the part of the cartridge adjacent the inlet forming part is formed in a conical shape corresponding to the inlet forming part.

6. The fabric treatment apparatus of claim 1, wherein the cartridge is further provided with a second hole, through which the additive receiving space communicates with the space defined between the housing and the cartridge.

7. The fabric treatment apparatus of claim 6, wherein the additive supply device is disposed such that the first hole and the second hole are located at different heights.

8. The fabric treatment apparatus of claim 1, wherein the additive supply device is disposed such that the inlet is located lower than the outlet.

9. The fabric treatment apparatus of claim 8, wherein the cartridge is provided in the housing such that the cartridge can be moved up and down.

10. The fabric treatment apparatus of claim 1, wherein the cartridge is configured such that the cartridge closes the inlet due to the elastic force of the elastic member when water is not supplied through the inlet.

11. The fabric treatment apparatus of claim 1, wherein the housing comprises:

a housing body having the inlet; and a housing cap detachably coupled to the housing body, the housing cap having the outlet.

12. The fabric treatment apparatus of claim 1, wherein the cartridge comprises:

a cartridge body having the first hole; and a cartridge cap detachably coupled to the cartridge body.

13. The fabric treatment apparatus of claim 1, further comprising:

a pump for supplying water to the inlet.

14. The fabric treatment apparatus of claim 1, wherein the additive contains an anti-scaling agent.

15. The fabric treatment apparatus of claim 1, wherein the cartridge comprises:

a cartridge body having the at least one hole; and a cartridge cap detachably coupled to the cartridge body.

16. The fabric treatment apparatus of claim 1, wherein the additive contains an anti-scaling agent.

17. A fabric treatment apparatus comprising:

a fabric receiving unit including a fabric receiving space formed therein;

a steam spray device for spraying steam into the fabric receiving unit; and an additive supply device for supplying an additive to water, wherein the additive supply device comprises:

a housing having an inlet, through which water is introduced, and an outlet, through which the water introduced through the inlet is discharged to the steam spray device;

a pump for supplying water to the inlet;

a cartridge having an additive receiving space formed therein, the cartridge being disposed in the housing such that the cartridge closes the inlet when the pump is not operated and is moved by water pressure applied through the inlet for opening the inlet when the pump is operated; and an elastic member for applying elastic force to the cartridge such that the cartridge is moved to the inlet, wherein the cartridge is provided with at least one hole, through which the additive receiving space communicates with a space defined between the housing and the cartridge, the at least one hole being closed by the housing in a state in which the inlet is closed and being opened according to movement of the cartridge in a state in which the inlet is open.

18. The fabric treatment apparatus of claim 17, wherein the additive supply device is disposed such that the inlet is located lower than the outlet.

19. The fabric treatment apparatus of claim 18, wherein the cartridge is provided in the housing such that the cartridge can be moved up and down.

20. A fabric treatment apparatus comprising:

a fabric receiving unit including a fabric receiving space formed therein;

a steam spray device for spraying steam into the fabric receiving unit; and an additive supply device for supplying an additive to water, wherein the additive supply device comprises:

a housing having an inlet, through which water is introduced, and an outlet at a higher position than the inlet, through the outlet the water introduced through the inlet discharged to the steam spray device;

a pump for supplying water to the inlet; and a cartridge having an additive receiving space formed therein, the cartridge disposed in the housing and configured to move in an upward direction from a first position to a second position by water pressure applied through the inlet and be returned to the first position from the second position by a weight thereof when the pump is not operated, wherein the cartridge is provided with at least one hole, through which the additive receiving space communicates with a space defined between the housing and the cartridge, the at least one hole being closed by the housing when the cartridge is at the first position and being opened as the cartridge moves in the upward direction from the first position to the second position.

21. The fabric treatment apparatus of claim 20, wherein the at least one hole is closed by contact with the housing when the pump doses not operate and is spaced apart from the housing and thus opened when the cartridge is moved as the pump operates.

22. The fabric treatment apparatus of claim 20, wherein the housing comprises:

an inlet forming part for opening and closing the first hole, the inlet forming part comprising the inlet;

an outlet forming part comprising the outlet; and a tubular middle housing part extending between the inlet forming part and the outlet forming part.

23. The fabric treatment apparatus of claim 22, wherein the cartridge comprises:

a middle cartridge part corresponding to the middle housing part, and one part selected from the middle housing part and the middle cartridge part is provided with a guide rail extending in a direction in which the cartridge is moved and the other part is provided with a guide groove associated with the guide rail for restraining rotation of the cartridge.

24. The fabric treatment apparatus of claim 22, wherein the first hole is formed at a part of the cartridge opposite to the inlet forming part.

25. The fabric treatment apparatus of claim 24, wherein the inlet forming part is formed in a conical shape in which an inner space of the inlet forming part is gradually widened from the inlet, and the part of the cartridge adjacent the inlet forming part is formed in a conical shape corresponding to the inlet forming part.

26. The fabric treatment apparatus of claim 20, wherein the at least one hole comprises a first hole and a second hole which are located at different heights from each other.

27. The fabric treatment apparatus of claim 20, wherein the housing comprises:

a housing body having the inlet; and a housing cap detachably coupled to the housing body, the housing cap having the outlet.

* * * * *